United States Patent [19]

Stjärne et al.

[11] Patent Number: 4,630,714

[45] Date of Patent: Dec. 23, 1986

[54] BLOCK BRAKE ACTUATOR FOR A RAIL VEHICLE

[75] Inventors: Olov G. Stjärne, Löddeköpinge; Lars M. Severinsson, Hishult, both of Sweden; Alastair C. B. Lowrie, Darlington, England

[73] Assignee: Sab Nife AB, Landskrona, Sweden

[21] Appl. No.: 678,834

[22] Filed: Dec. 6, 1984

[30] Foreign Application Priority Data

Dec. 21, 1983 [SE] Sweden ..... 8307077

[51] Int. Cl.[4] ..... B61H 13/24

[52] U.S. Cl. ..... 188/206 R; 188/153 R; 267/160

[58] Field of Search ..... 188/206 R, 205 R, 51, 188/52, 53, 54, 55, 209, 207, 153 R; 267/160, 158, 30, 19 A, 19 R; 248/630, 611, 629, 610

[56] References Cited

U.S. PATENT DOCUMENTS

| | | | |
|---|---|---|---|
| 2,820,625 | 1/1958 | Davis | 267/158 |
| 3,727,900 | 4/1973 | Casey | 267/160 |
| 4,406,444 | 9/1983 | Bogenschutz | 248/618 X |

FOREIGN PATENT DOCUMENTS

| | | | |
|---|---|---|---|
| 401402 | 11/1933 | United Kingdom | 188/206 R |

*Primary Examiner*—George E. A. Halvosa
*Assistant Examiner*—Matthew C. Graham
*Attorney, Agent, or Firm*—Laurence R. Brown

[57] ABSTRACT

A rail vehicle block brake actuator (1) shall be fixedly mounted, but its brake block holder (4) shall brakingly engage an axially movable wheel (25). For this purpose the brake block holder is laterally movably suspended relative to the brake actuator by means of pivotable hangers (5) each consisting of a stack of leaf springs. These leaf springs (5) are preferably prestressed in a direction for compensating for the bias of the taper of the wheel tread, which it is intended to engage, but are held in a straight condition by means of a flat bar (9).

2 Claims, 3 Drawing Figures

Fig.1

Fig.2
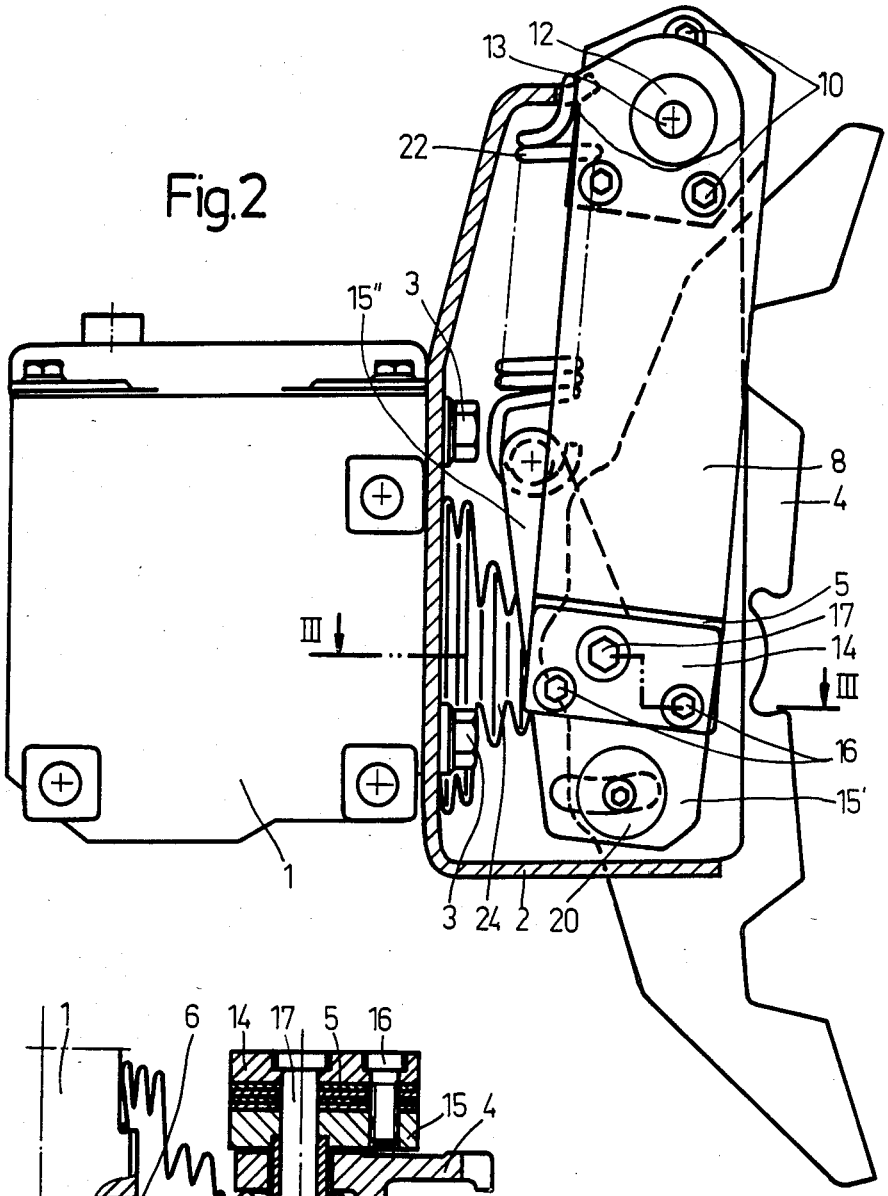
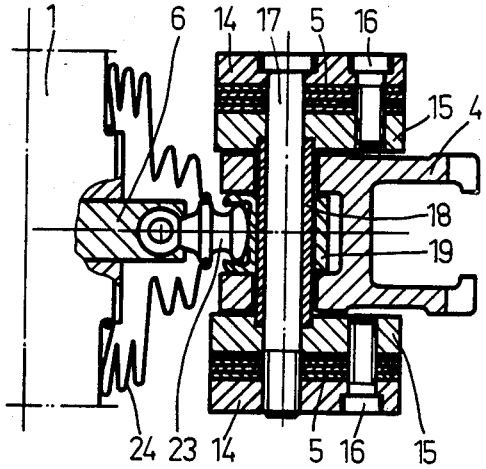
Fig.3

BLOCK BRAKE ACTUATOR FOR A RAIL VEHICLE

TECHNICAL FIELD

This invention relates to a rail vehicle block brake actuator with a brake block holder laterally movably suspended relative to the brake actuator so as to be movable laterally during braking together with an axially movable wheel to be braked, although the actuator itself is fixedly mounted, whereby hangers suspending the brake block holder consist of leaf springs, preferably a stack of several springs at each side of the brake block holder, pivoted to a part on the actuator and to the brake block holder, respectively.

BACKGROUND ART

A block brake actuator, normally a so called brake unit containing a brake cylinder and a stack adjuster can conventionally be provided with a brake block holder suspended therefrom. The suspension by hangers or suspension links is such that the brake block holder (provided with brake blocks) can pivot in the plane of the actuator push rod to and fro braking engagement with a wheel to be braked.

When the brake actuator is fixedly mounted in the vicinity of the wheel to be braked, only very limited axial movements of the wheel or wheel-set can be allowed.

In recent years there has been a clear tendency towards rail vehicle designs allowing greater axial movements of the wheel-sets. One way of solving the problem of using a conventional brake unit of the kind described at axially movable wheels is shown in the International P.C.T. Publication No. WO-A-80/00682, published Apr. 17, 1980, where the whole unit together with the suspension and brake block holder is laterally movably suspended.

For different reasons such a solution may not be utilized in many cases, and preferably the actuator is to be fixedly mounted in a rail vehicle underframe or bogie in the vicinity of the wheel to be braked.

The problem of braking an axially movable wheel by means of a fixedly mounted brake actuator may as known be solved in that the brake block holder is laterally movably suspended relative to the brake actuator. As shown in U.S. Pat. No. 4,406,444 the hangers suspending the brake block holder can consist of leaf springs.

THE INVENTION

According to the invention the leaf springs are prestressed in a direction for compensating for the bias of the taper of the wheel tread which it is intended to engage.

Preferably, a flat bar is arranged at one side of one of the stacks of leaf springs along the major length thereof in order to keep the leaf springs straight in their rest position in spite of their prestress.

BRIEF DESCRIPTION OF THE DRAWINGS

The invention will be described in further detail below reference being made to the accompanying drawings, in which FIG. 2 is a side view, partly sectioned along the lines II—II in FIG. 1, and FIG. 3 is a section along the lines III—III in FIG. 2.

DETAILED DESCRIPTION OF A PRACTICAL EMBODIMENT

Figure 1:
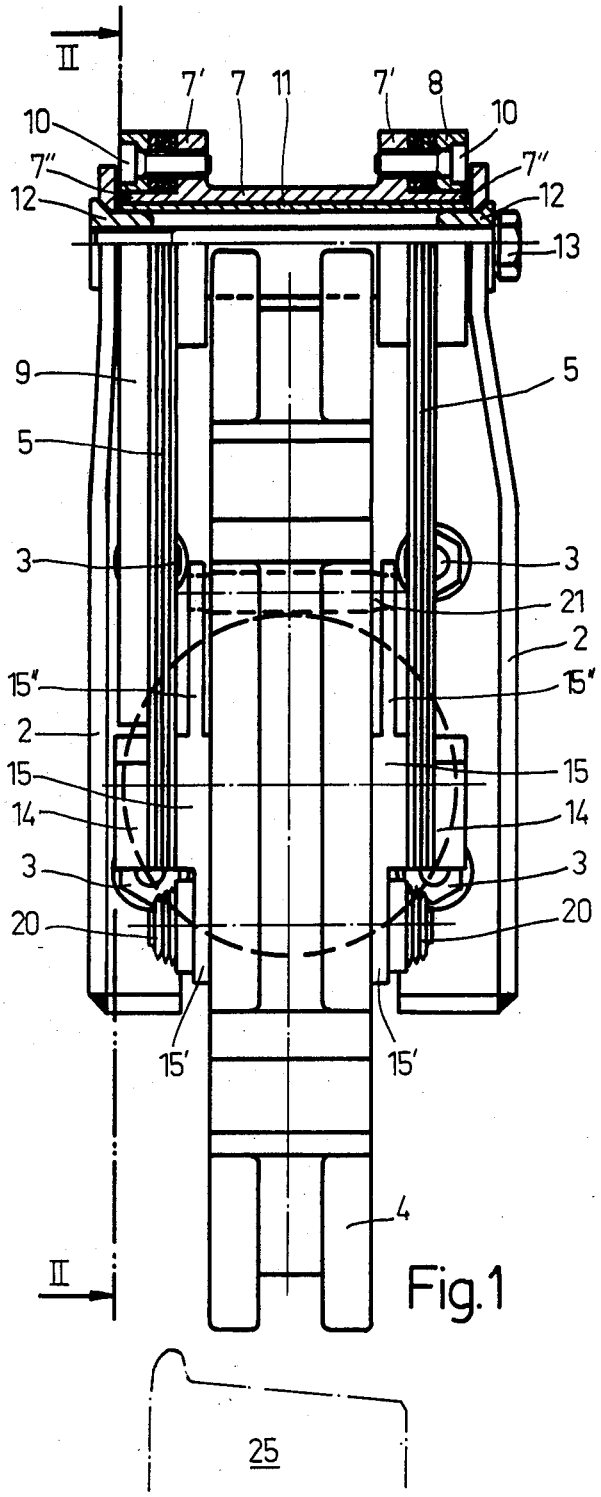
FIG. 1 is a front view, sectioned in its uppermost part, of a first embodiment of a brake actuator with a brake block holder according to the invention.

A conventional brake actuator 1 forming no part of the present invention and normally including a brake cylinder and a slack adjuster (so as to form a brake unit) is provided with a mounting bracket 2 in the general form of an open-sided casing. The bracket 2 is attached to the bracke actuator 1 by means of screws 3.

Without going into details at this stage, a brake block holder 4 is suspended in two hangers 5 pivotally attached to the bracket 2 at their respective upper ends and to the brake block holder 4 towards their lower ends. At the pivot point between the hangers 5 and the brake block holder 4 the outgoing push rod 6 of the brake actuator 1 (FIG. 3) is arranged to submit is pushing brake force to the brake block holder 4.

The pivotal connection between the bracket 2 and the brake block hangers 5 has the following design: A cylindrical sleeve 7 has two radial flanges 7' and two trunnions 7" axially outside thereof. The hangers 5, each consisting of a stack of for example four leaf springs, are treaded over the trunnions 7" followed by a holder 8 at the right hand side as viewed in FIG. 1 and a longer flat bar 9 at the left hand side extending down towards the pivotal connection to the brake block holders 4. The whole arrangement at both sides is held together by screws 10.

The arrangement 5, 7–10 thus formed is pivotally attached to the bracket 2 by means of a bushing 11, two end pieces 12, and a central screw 13.

A somewhat similar design is used for the lower pivotal connection between the hangers 5 and the brake block holder 4, as appears most clearly in FIG. 3

The lower end of each hanger 5 is provided with a holder 14 at its outwardly facing side and a connection member 15 at its inwardly facing side, held together by screws 16. The connection with the brake block holder 4 is accomplished by means of a through screw 17 surrounded by a distance holding bushing 18 and a force receiving member 19.

Each connection member 15 has an extension 15' downwards with a conventional friction device 20 for the purpose of keeping the brake block holder 4 in a substantially vertical position or rather in the position afforded to it at the foregoing braking operation. Also, each connection member 15 has an arm 15" extending upwards. These arms 15" are interconnected by a pin 21 providing a lower attachment for a brake block holder return spring 22, whose upper end is attached to the bracket 2 near the connection to the hangers 5.

At the end of the push rod 6 extending out of the brake actuator 1 (FIG. 3) there is a force transmitting member 23, which is pivotally attached to the push rod 6 for lateral movements substantially in the plane of FIG. 3. Its end surface for cooperation with a plane surface of the force receiving member 19 is cylindrical with its center coinciding with the pivot center for the force transmitting member 23. In this way the brake block holder 4 will be fully movable in the lateral direction relative to the brake actuator 1 itself also during force transmission.

As a modification, however, the push rod itself (normally forming part of a slack adjuster built into the brake actuator) may be pivotally mounted in the brake actuator and be directly connected with the brake block holder movable therewith.

A rubber bellows 24 attached to the brake actuator 1 and the force transmitting member 23 will prevent dust, dirt and the like from entering the actuator 1.

As usual the brake block holder 4 is to be pivoted with conventional brake blocks (not shown), which are to be replaced when worn out. These brake blocks are to brakingly engage the tread of a rail vehicle wheel 25, whose lateral position is indicated in dash-dotted lines in FIG. 1 in the normal or rest condition. The leaf springs constituting the hangers 5 are slightly prestressed to the left in FIG. 1 so as to compensate for the bias to the right accomplished by the normal taper of the wheel tread at braking. The hangers 5 will, however, be maintained in the shown vertical position also in the rest position by the flat bar 9.

If the wheel 25 moves to the right in FIG. 1 relative to the brake block holder 4 with its brake blocks, the wheel flange will accomplish a movement to the right of the brake block holder 4 against the force of the leaf springs of the hangers 5, but only until the right hand side holder 14 hits the side wall of the bracket 2.

A brake actuator with a brake block holder according to the invention is especially well suited for the case (which is becoming increasingly usual) that the wheel-sets of a rail vehicle are movable to a considerable extent also in the axial direction. In such a case the brake actuator itself can be fixedly mounted to the vehicle underframe or bogie in the vicinity of the wheel to be braked, whereas the brake block holder (with its brake blocks) is allowed to follow the axial movement of the wheel-set during braking.

As appears from FIG. 1, the arrangement is somewhat asymmetric in that the flat bar 9 is placed at the same side of the brake block holder 4 as the flange of the wheel 25 and in that the springs of the hangers 5 are prestressed in the same direction. A similar arrangement placed at the opposite side of the vehicle has accordingly to be inverted.

We claim:

1. For use with a flanged wheel set having a flange on each wheel and each wheel having a tapered tread, a rail vehicle brake system having a brake actuator affixed to the vehicle by a bracket having a brake block holder suspended by hangers for operation by the brake actuator on the brake block hangers by movement during a braking stroke causing the brake blocks to follow the axial wheel movement of the wheel set, a wheel taper compensating structure wherein said hangers are leaf springs pivoted to the bracket and brake block holder and movable with axial movement of the flanged wheel set, said leaf springs being prestressed in a direction toward the wheel flange prior to and subsequent with engagement with the tapered wheel tread and thus overcoming bias exertion on the brake block by the wheel taper tending to cause the brake block to move down the wheel taper because of the component force acting down the taper for compensating for the bias of the taper of the wheel tread over a range of axial movement of the wheel set.

2. A wheel taper compensating structure as claimed in claim 1 further comprising a flat bar positioned at the wheel flange side of the prestressed leaf springs along the major length thereof maintaining the leaf springs straight in their rest position in spite of their prestress.

* * * * *